US006116442A

United States Patent [19]

Higgins

[11] Patent Number: 6,116,442

[45] Date of Patent: Sep. 12, 2000

[54] TAMPER INDICATING CLOSURE

[75] Inventor: Phillip Higgins, Rowville, Australia

[73] Assignee: Amcor Limited, South Melbourne, Australia

[21] Appl. No.: 09/061,295

[22] Filed: Apr. 16, 1998

[30] Foreign Application Priority Data

Apr. 17, 1997 [AU] Australia ..... PO6247

[51] Int. Cl.[7] ..... B65D 41/34

[52] U.S. Cl. ..... 215/252

[58] Field of Search ..... 215/252, 256, 215/330

[56] References Cited

U.S. PATENT DOCUMENTS

| | | | |
|---|---|---|---|
| Re. 33,265 | 7/1990 | Gregory et al. . | |
| 4,448,822 | 5/1984 | Lee et al. . | |
| 4,458,821 | 7/1984 | Ostrowsky . | |
| 4,470,513 | 9/1984 | Ostrowsky . | |
| 4,478,343 | 10/1984 | Ostrowsky . | |
| 4,592,476 | 6/1986 | Yasada . | |
| 4,613,052 | 9/1986 | Gregory et al. . | |
| 4,653,657 | 3/1987 | Papavasilopoulos | 215/252 |
| 4,657,153 | 4/1987 | Hayes . | |
| 4,796,770 | 1/1989 | Begley . | |
| 4,813,561 | 3/1989 | Ochs . | |
| 5,346,082 | 9/1994 | Ochs et al. | 215/252 |
| 5,450,973 | 9/1995 | Ellis et al. | 215/252 |
| 5,462,184 | 10/1995 | Ingram et al. . | |
| 5,472,106 | 12/1995 | Nofer . | |
| 5,570,798 | 11/1996 | Hayashida et al. | 215/252 |
| 5,611,446 | 3/1997 | Ingram et al. . | |
| 5,657,889 | 8/1997 | Guglielmini . | |
| 5,727,705 | 3/1998 | Kelly | 215/252 |
| 5,775,527 | 7/1998 | Bosl et al. | 215/252 |
| 5,779,075 | 7/1998 | Salmon et al. | 215/252 |
| 5,813,553 | 9/1998 | Herr et al. | 215/252 |

FOREIGN PATENT DOCUMENTS

| | | | |
|---|---|---|---|
| 0 764 591 A1 | 9/1996 | European Pat. Off. . | |
| 4108453 | 10/1991 | Germany | 215/252 |
| 4214151 | 11/1993 | Germany | 215/252 |
| 259333 | 12/1995 | New Zealand . | |
| 91/03405 | 3/1991 | WIPO | 245/252 |

*Primary Examiner*—Nathan Newhouse
*Attorney, Agent, or Firm*—Workman, Nydegger & Seeley

[57] ABSTRACT

The tamper indicating closure disclosed herein is designed for use with containers having a threaded neck section and an annular bead or flange located below the threaded neck section. The tamper indicating closure includes a cap with a top wall and a downwardly extending annular side wall. The cap includes a thread on the inner surface of the side wall for locating the closure on the threaded section of the container neck, and a tamper indicating member is connected to the lower section of the side wall. The tamper indicating member includes an annular band with a plurality of upwardly extending locking tabs. A plurality of flexible hinges are used to interconnect the locking tabs and the annular band. The locking tabs are configured to react against the annular head or flange of the container neck to prevent the removal of the annular band from the container when the closure is in a closed position.

10 Claims, 3 Drawing Sheets

TAMPER INDICATING CLOSURE

The present invention relates to a tamper indicating closure for a container having a threaded neck.

The present invention relates particularly to a tamper indicating closure of the type which comprises:

(i) a cap having a top wall and an annular side wall depending downwardly from the top wall;

(ii) a thread on the inside surface of the annular side wall; and (iii) a tamper indicating band connected by bridges to a lower end of the side wall.

The above-described type of tamper indicating closure is designed for containers having a threaded neck portion and an annular bead or flange beneath the threaded portion. Specifically, the closure is designed to be initially positioned in a closed position on a container by screwing the closure onto the neck of the container so that the tamper indicating band is located below the annular bead or flange on the container. The arrangement is such that the annular bead or flange prevents upward axial movement of the tamper indicating band. As a consequence, rotation of the cap to remove the closure causes the cap to move axially away from the tamper indicating band and thereby causes the interconnecting bridges to sever to separate the cap and the band.

There is a large number of known forms of this type of tamper indicating closure, and a selection of these closures are in commercial use in Australia and in other countries. Known closures include the closures described in Australian patent 568791 in the name of Owens-Illinois Inc. and U.S. Pat. No. 4,478,343 in the name of Efrem Ostrowsky.

A disadvantage of many of the known forms of the tamper indicating closure is that there is a relatively loose fit of the tamper indicating band on the neck, and this makes it possible to manipulate the tamper indicating band over the annular bead or flange on the closure and thereby remove the closure from the container without severing the interconnecting bridges. This presents a potential security risk because it is possible for a person to open a container, tamper with the contents of the container, and reapply the closure without there being any physical indication that the container has been opened. The closures disclosed in the above-mentioned Australian and U.S. patents are different solutions to alleviate this disadvantage of other closures.

An object of the present invention is to provide a tamper indicating closure that alleviates the disadvantage described in the preceding paragraph.

According to the present invention there is provided a tamper indicating closure for a container, the container having a neck with a threaded section and an annular bead or flange below the threaded section, the closure comprising: a cap having a top wall and an annular side wall depending downwardly from the top wall; a thread on an inside surface of the side wall for locating the closure on the threaded section of the container neck; a tamper indicating member; a means connecting the tamper indicating member to a lower section of the side wall; and the tamper indicating member comprising:

(i) an annular band;

(ii) a plurality of locking tabs extending from the band upwardly and inwardly with respect to the band for reacting against the annular bead or flange of the container neck to prevent removal of the band from the container when the closure is in a closed position on the container neck with the locking tabs in a closure position;

(iii) a plurality of flexible hinges interconnecting the locking tabs and the band which allow the locking tabs to fold outwardly from a pre-closure position towards the band as a result of contact with the annular bead or flange as the locking tabs are moved downwardly over the annular bead or flange as the closure is initially positioned in the closed position on the container neck; and (iv) a plurality of webs interconnecting the locking tabs, the webs being deformed resiliently when the locking tabs fold outwardly from the pre-closure position as the closure is being positioned in the closed position on the container neck, and the resilient deformation of the webs biasing the locking tabs inwardly and locating and maintaining the locking tabs in the closure position when the closure is in the closed position.

Preferably the above described webs are formed to ensure that the locking tabs contact the container neck in the closure position to ensure that there is a tight fit of the locking tabs, and therefore the tamper indicating member, on the container neck.

The closure may be formed from any suitable material.

It is preferred that the closure be formed by injecting moulding a plastics material.

It is preferred that the side edges of adjacent locking tabs diverge from the band and that, as a consequence, the webs be generally triangular-shaped.

It is preferred that the thickness of the webs be relatively small compared with the thickness of the locking tabs.

It is preferred that each web be connected to the side edge of one locking tab in the region of an inwardly facing surface of that tab and to the side edge of an adjacent locking tab in the region of an outwardly facing surface of that tab.

It is preferred that each locking tab be arcuate with one of the side edges being located radially inwardly of the other side edge. With this arrangement the locking tabs form a ratchet profile that is adapted to interlock with projections of the container neck.

It is preferred that the means connecting the tamper indicating member to the side wall be a plurality of bridges.

The thread on the inside surface of the side wall may be continuous or discontinuous.

According to the present invention there is also provided, in combination, a container having a neck with a threaded section and an annular bead or flange below the threaded section, and the closure described in the preceding paragraphs positioned on the container neck.

The present invention is described further by way of example with reference to the accompanying drawings, of which:

Figure 3:
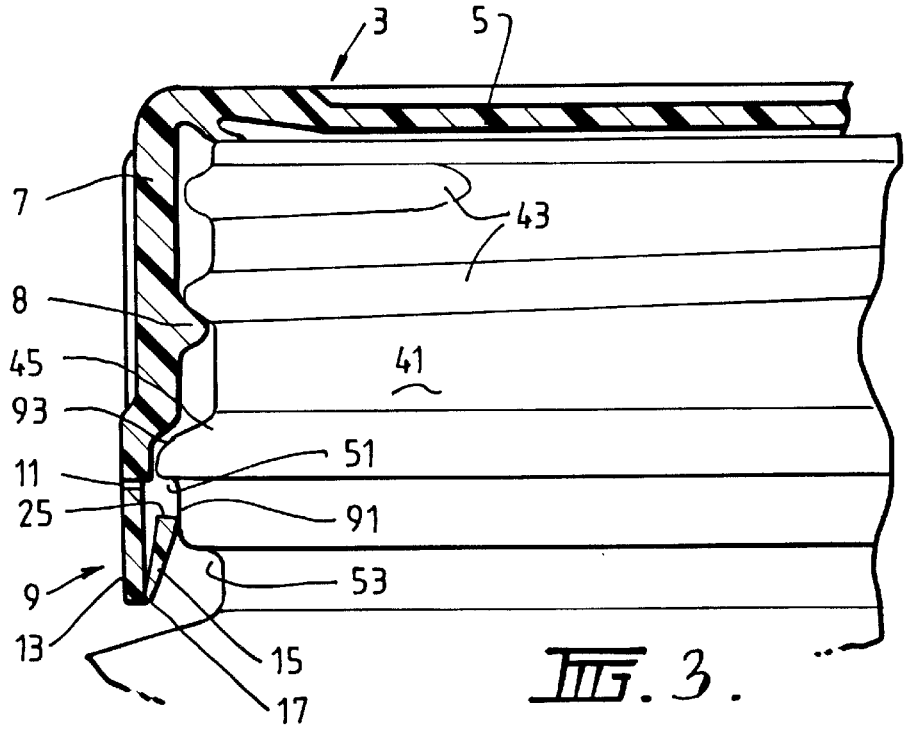
FIG. 3 is a partially cut-away perspective view of the closure shown in FIGS. 1 and 2 after the locking tabs and interconnecting webs have been folded upwardly illustrating the location of the locking tabs in a closure position on a neck of a container.

With particular reference initially to FIG. 3, the closure shown in the figures is adapted to be positioned on a container which comprises a neck 41 with an externally threaded section 43 and an annular bead or flange (hereinafter referred to as "bead") 45 below the threaded section 43. The bead 45 is formed with two undercut surfaces or shoulders 51, 53, an axial wall section 91 that extends between the undercut surfaces 51, 53, and a wider axial wall section 93 located above the undercut surface 51. The bead 45 may be of any suitable shape.

The container may be of any suitable shape and be formed from any suitable material. The closure also may be formed from any suitable material (such as a plastic material).

The closure comprises:

(i) a cap 3 having a top wall 5 and an annular side wall 7 with an internal thread 8 depending downwardly from the top wall 5;

(ii) a tamper indicating member, generally identified by the numeral 9; and (iii) a plurality of bridges, generally identified by the numeral 11, which interconnect a lower end of the side wall 7 and an upper end of the tamper indicating member 9.

The cap 3 and the bridges 11 may be of any suitable shape.

The tamper indicating member 9 comprises an annular band 13, a plurality of locking tabs 15 extending from a lower end of the band 13, a plurality of flexible hinges 17 interconnecting the band 13 and the locking tabs 15, and a plurality of webs 21 interconnecting adjacent locking tabs 15.

The locking tabs 15 and the webs 21 form a continuous retaining band that is connected by the hinges 17 to the band 13.

Figure 1:
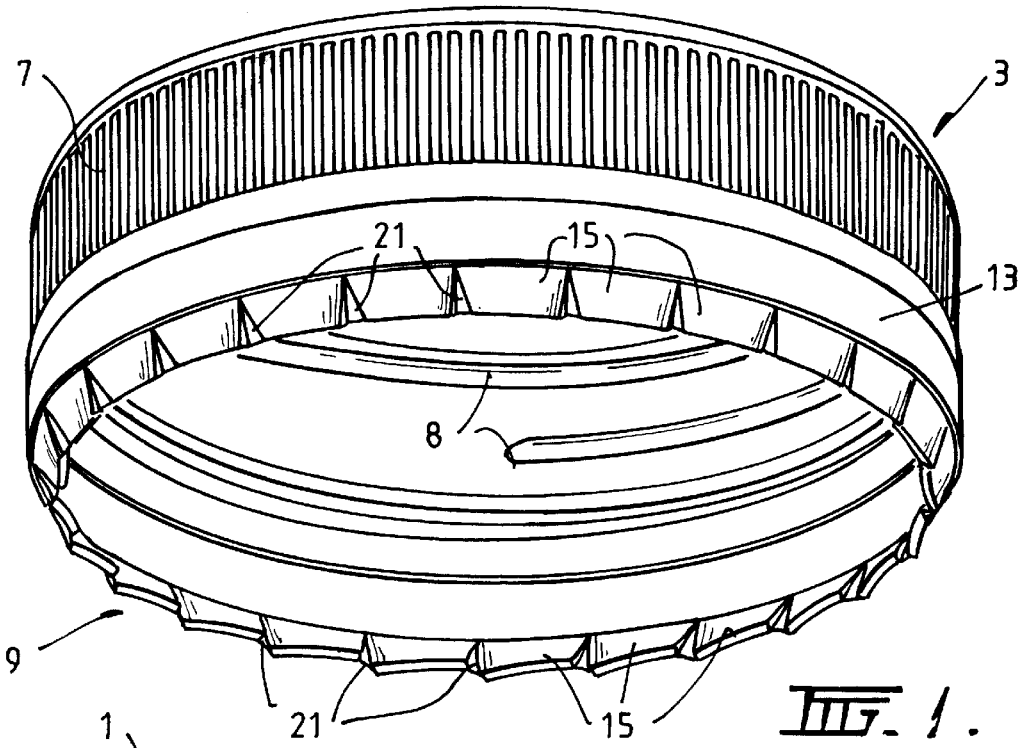
FIG. 1 is a perspective view of a preferred embodiment of a closure in accordance with the present invention in an as-moulded position in which the locking tabs and interconnecting webs of the closure are in a folded-down position.
Figure 2:
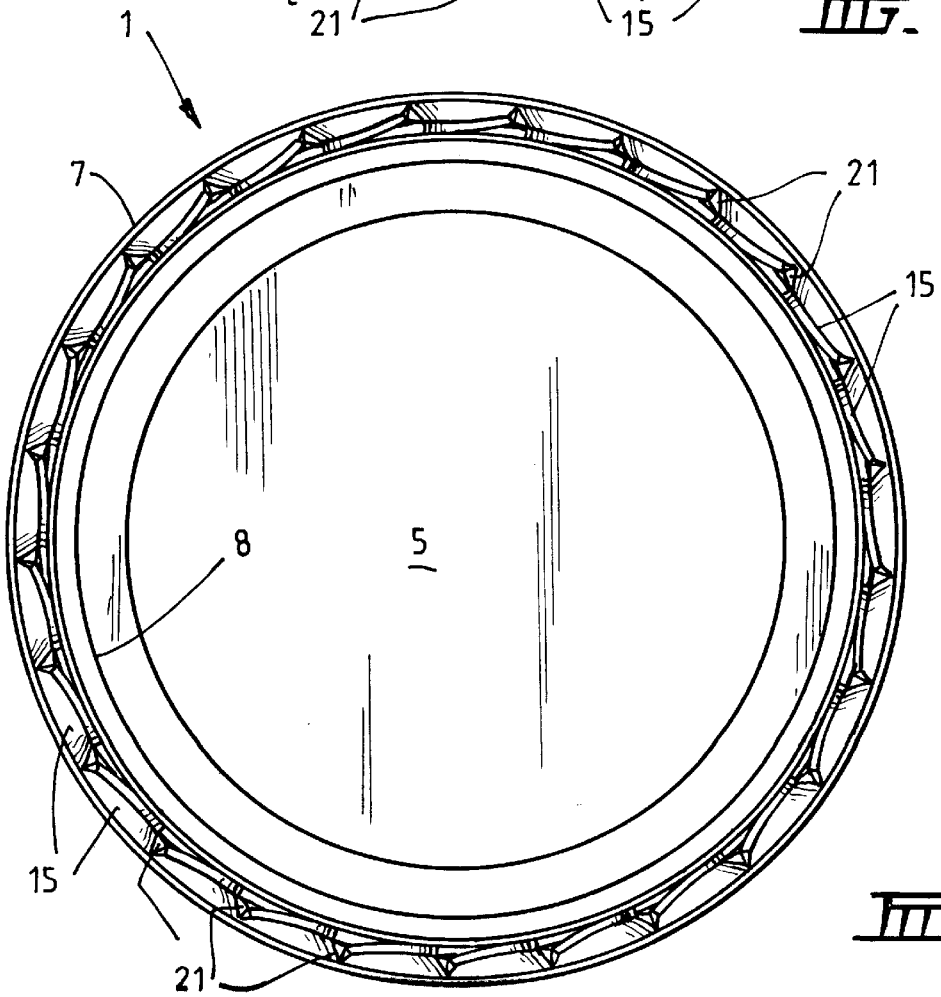
FIG. 2 is an underside view of the closure shown in FIG. 1.
Figure 4:
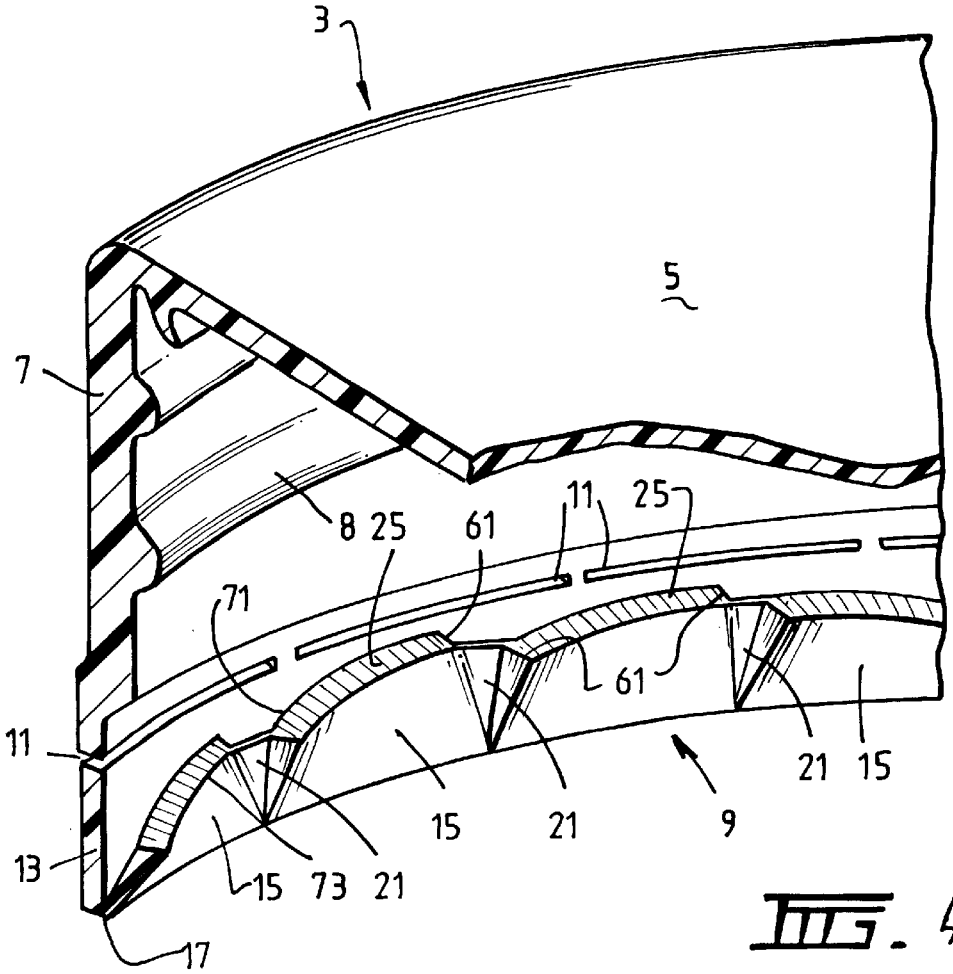
FIG. 4 is a partially cut-away perspective view of the closure shown in FIGS. 1 to 3 illustrating the position of the locking tabs and interconnecting webs in a pre-closure position after folding the locking tabs and interconnecting webs from the as-moulded position shown in FIG. 1 and before locating the closure in the closure position on the container neck.

The closure may be moulded with the continuous retaining band folded down as shown in FIGS. 1 and 2 or with the continuous retaining band folded up into the operative position shown in FIGS. 3 and 4.

Figure 5:
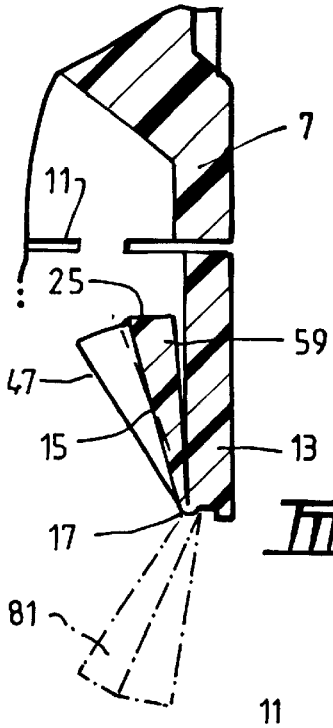
FIG. 5 is a section which illustrates the extent of possible movement of the locking tabs of the closure shown in FIGS. 1 to 4.

With reference to FIGS. 1 and 5, in the as-moulded position shown in these figures, the locking tabs 15 and the webs 21 extend generally downwardly and inwardly from the lower end of the band 13 (shown as the more vertically oriented of the dotted outlines in FIG. 5 and marked with the reference numeral 81).

The side edges 61 of adjacent locking tabs 15 diverge and, as a consequence, the webs 21 are generally triangular-shaped. The locking tabs 15 and the webs 21 may be of any other suitable shape.

In addition, the thickness of the webs 21 is relatively small when compared with that of the locking tabs 15. The locking tabs 15 and the webs 21 may be of any suitable thickness.

Figure 7:
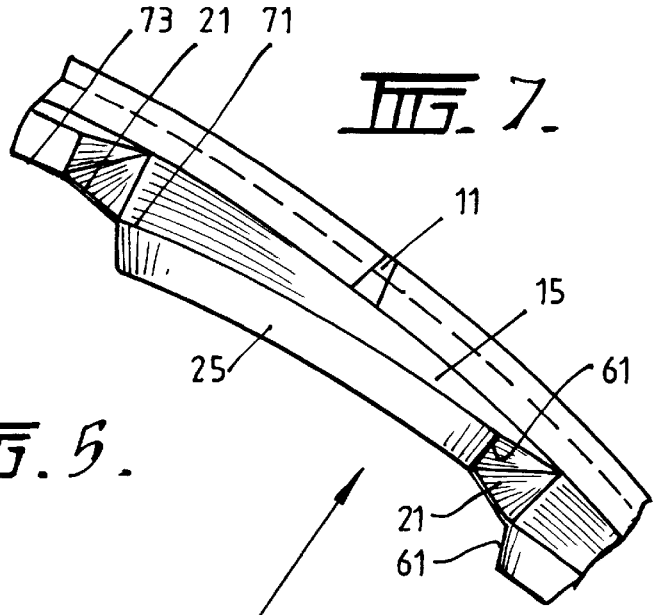
FIG. 7 is an enlargement of the circled region of FIG. 6.
Figure 6:
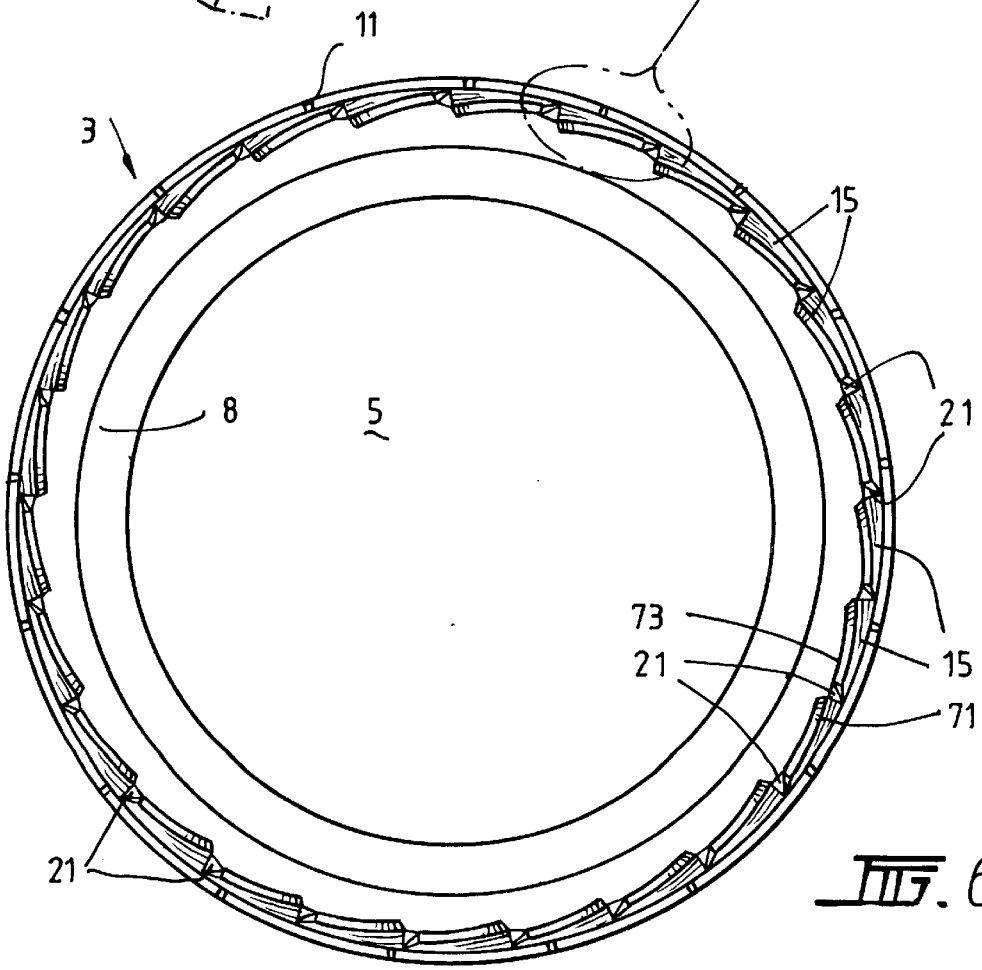
FIG. 6 is a top view of the tamper indicating member in the pre-closure position shown in FIG. 4 and with the annular band of the tamper indicating member removed for clarity.

Moreover, the locking tabs 15 and the webs 21 are formed so that, as viewed in FIGS. 4 6 and 7, each web 21 extends from an outwardly facing surface 71 at one side end 61 of one locking tab 15 to an inwardly facing surface 73 at one side edge 61 of an adjacent locking tab 15. Moreover, each locking tab 15 is arcuate so that, as viewed in FIGS. 4, 6 and 7, one side edge 61 and the inwardly facing surface 71 adjacent that side edge 61.

In order to position the closure on the container (not shown) it is necessary first to fold the locking tabs 15 and the webs 21 from the as-moulded position shown in FIGS. 1, 2 and 5 (in dotted outline only) inwardly about the hinges 17 to a pre-closure position (hereinafter referred to as the "rest position") position as shown in FIG. 4 and identified by the numeral 47 in FIG. 5. In the rest position the locking tabs 15 extend upwardly and inwardly toward the top wall 5 of the closure.

With reference to FIG. 5, it can be appreciated that the movement of the locking tabs 15, and the webs 21, from the as-moulded position 81 to the rest position 47 initially reduces and thereafter increases the effective circumference of the continuous retaining band formed by the locking tabs 15 and webs 21. The initial reduction in circumference is accommodated by folding of the webs 21 as the sides of adjacent locking tabs 15 approach. Forming the closure so that each web 21 extends from that outwardly facing surface 71 of one locking tab 15 to the inwardly facing surface 73 of an adjacent locking tab 15—as these faces are viewed in FIGS. 6 and 7—assists in folding of the webs 21.

With the locking tabs 15 in the rest position 47 the closure is then screwed onto the container, and this movement has the consequence of moving the tamper indicating member 9 over the wider wall section 93 of the annular bead 45 on the neck 43 of the container to position the closure with the terminal ends 25 of the locking tabs 15 below the undercut surface 51 of the bead 45. In this position, the undercut surface 51 of the annular bead 45 resists removal of the locking tabs 15 from the container. As a consequence, the release of the cap 3 of the closure from the container can only be achieved by unscrewing the cap 3 until the axial movement of the cap 3 relative to the tamper indicating member 9 severs the bridges 11 that interconnect the tamper indicating member 9 and the cap 3.

FIG. 5 illustrates that movement of the locking tabs 15 over the wider wall section 93 of the annular bead 45 on the container neck as the closure is being positioned on the container forces the locking tabs 15 to fold outwardly about the hinges 17 from the rest position 47 to the position identified by the numeral 59 in FIG. 5. This movement of the locking tabs 15 increases the circumference of the band of the locking tabs 15 and the webs 21 and this increase is accommodated largely by resilient deformation of the webs 21. The effect of this resilient deformation is that, after the locking tabs 15 move past the undercut surface 51 of the bead 45, and thereby are no longer constrained by the wider wall section 93 of the bead 45, the resilience of the webs 21 biases the locking tabs 15 towards the rest position and, more particularly, against the wall section 91 of the bead 45 and thereby into the closure position shown in FIG. 3. This closure position is intermediate the positions 47 and 59 shown in FIG. 5. In this connection, the dimensions of the closure and the container neck are selected so that the position of the locking tabs 15 in the closure position shown in FIG. 3 is not the rest position 47. This means that the wall section 91 of the bead 45 that contacts the locking tabs 15 prevents the locking tabs 15 folding inwardly to the rest position. This ensures that the resilience of the webs 21 biases the locking tabs 15 against the container neck and, as a consequence, there is a tight fit of the locking tabs 15 on the container neck.

In the preferred embodiment shown in the figures, the arrangement of the arcuate locking tabs 15 and the connections of the webs 21 to the outwardly and inwardly facing surfaces 71, 73 at the side edges 61 of the locking tabs 15 as shown in FIGS. 4, 6 and 7 results in each locking tab 15 having a ratchet profile with a leading side edge and a radially inwardly located trailing side edge—with respect to the rotation of the closure onto a container neck. With this arrangement, the trailing edges form ratchet teeth that can contact and interlock with suitably positioned projections (not shown) on the container neck to resist unscrewing of the tamper indicating member 9 and thus improve breakage of the bridges 11 by shear breakage as well as tensile breakage.

Many modifications may be made to the preferred embodiment described above without departing from the spirit and scope of the present invention.

For example, whilst the container shown in FIG. 3 comprises a continuous annular bead 45, it can readily be appreciated that the invention is not so limited to this arrangement and the bead 45 may be discontinuous.

Furthermore, whilst the drawings illustrate the relative size and location of the various components of the preferred embodiment of the container, it can readily be appreciated that the present invention is not limited to this arrangement.

It is noted that the terms "comprises" and "comprising" are understood to have the same meaning as the terms "includes" and "including", respectively and not the same meaning as the terms "consists" and "consisting".

I claim:

1. A tamper indicating closure for a container, the container having a neck with a threaded section and an annular bead or flange below the threaded section, the closure comprising: a cap having a top wall and an annular side wall depending downwardly from the top wall; a thread on an inside surface of the side wall for locating the closure on the threaded section of the container neck; a tamper indicating member; a means connecting the tamper indicating member and a lower section of the side wall; and the tamper indicating member comprising:

(i) an annular band;

(ii) a plurality of locking tabs extending from the band upwardly and inwardly with respect to the band for reacting against the annular bead or flange of the container neck to prevent removal of the band from the container when the closure is in a closed position on the container neck with the locking tabs in a closure position, each locking tab having an inwardly facing surface and an outwardly facing surface and side edges that interconnect the surfaces whereby the spacing between the surfaces defines the thickness of the locking tab, the side edges of adjacent locking tabs diverging from the band, and each locking tab being shaped so that one side edge and the inwardly facing surface adjacent that side edge are located radially inwardly of the other side edge and the inwardly facing surface adjacent that side edge;

(iii) a plurality of flexible hinges interconnecting the locking tabs and the band which allow the locking tabs to fold outwardly from a pre-closure position towards the band as a result of contact with the annular bead or flange as the locking tabs are moved downwardly over the annular bead or flange as the closure is positioned in the closed position on the container neck; and (iv) a plurality of generally triangular-shaped webs connected to the diverging side edges of adjacent locking tabs, the webs being deformed resiliently when the locking tabs fold outwardly from the pre-closure position as the closure is being positioned in the closed position on the container neck, and the resilient deformation of the webs biasing the locking tabs inwardly and locating and maintaining the locking tabs in the closure position when the closure is in the closed position.

2. The closure defined in claim 1 wherein each web has a thickness that is relatively small compared with the thickness of the locking tabs.

3. The closure defined in claim 1 wherein each locking tab is arcuate.

4. The closure defined in claim 1 wherein each web is connected to the radially outwardly located side edge of one locking tab in the region of the inwardly facing surface of that locking tab and to the radially inwardly located side edge of an adjacent locking tab in the region of the outwardly facing surface of that locking tab.

5. The closure defined in claim 1 wherein the position of the locking tabs when the closure in the pre-closure position is radially inward of the position of the locking tabs when the closure is in the closed position.

6. In combination, a container having a neck with a threaded section and an annular bead or flange below the threaded section, and a closure positioned on the container neck, the closure comprising: a cap having a top wall and an annular side wall depending downwardly from the top wall; a thread on an inside surface of the side wall for locating the closure on the threaded section of the container neck; a tamper indicating member; a means connecting the tamper indicating member and a lower section of the side wall; and the tamper indicating member comprising:

(i) an annular band;

(ii) a plurality of locking tabs extending from the band upwardly and inwardly with respect to the band for reacting against the annular bead or flange of the container neck to prevent removal of the band from the container when the closure is in a closed position on the container neck with the locking tabs in a closure position, each locking tab having an inwardly facing surface and an outwardly facing surface and side edges that interconnect the surfaces whereby the spacing between the surfaces defines the thickness of the locking tab, the side edges of adjacent locking tabs diverging from the band, and each locking tab being shaped so that one side edge and the inwardly facing surface adjacent that side edge are located radially inwardly of the other side edge and the inwardly facing surface adjacent that side edge;

(iii) a plurality of flexible hinges interconnecting the locking tabs and the band which allow the locking tabs to fold outwardly from a pre-closure position towards the band as a result of contact with the annular bead or flange as the locking tabs are moved downwardly over the annular bead or flange as the closure is positioned in the closed position on the container neck; and (iv) a plurality of generally triangular-shaped webs connected to the diverging side edges of adjacent locking tabs, the webs being deformed resiliently when the locking tabs fold outwardly from the pre-closure position as the closure is being positioned in the closed position on the container neck, and the resilient deformation of the webs biasing the locking tabs inwardly and locating and maintaining the locking tabs in the closure position when the closure is in the closed position.

7. The closure defined in claim 6 wherein each web has a thickness that is relatively small compared with the thickness of the locking tabs.

8. The closure defined in claim 6 wherein each locking tab is arcuate.

9. The closure defined in claim 6 wherein each web is connected to the radially outwardly located side edge of one locking tab in the region of the inwardly facing surface of that locking tab and to the radially inwardly located side edge of an adjacent locking tab in the region of the outwardly facing surface of that locking tab.

10. The closure defined in claim 6 wherein the position of the locking tabs when the closure in the pre-closure position is radially inward of the position of the locking tabs when the closure is in the closed position.

* * * * *

UNITED STATES PATENT AND TRADEMARK OFFICE

CERTIFICATE OF CORRECTION

PATENT NO. : 6,116,442
DATED : September 12, 2000
INVENTOR(S) : Phillip Higgins

It is certified that error appears in the above-identified patent and that said Letters Patent is hereby corrected as shown below:

ABSTRACT,
Line 14, before "or flange" change "head" to -- bead --

Column 2,
Line 28, after "formed by" change "injecting" to -- injection --

Column 4,
Line 8, after "FIGS. 4" insert a comma
Line 14, after "that side edge 61" insert -- are located radially inwardly of the other side edge 61 and the inwardly facing surface 71 adjacent that side edge 61 --
Line 22, before "as shown" delete "position"

Signed and Sealed this

Twenty-fifth Day of December, 2001

*Attest:*

*Attesting Officer*

JAMES E. ROGAN
*Director of the United States Patent and Trademark Office*